United States Patent [19]

Eickmann

[11] 4,374,486

[45] Feb. 22, 1983

[54] RADIAL PISTON MOTOR OR PUMP

[76] Inventor: Karl Eickmann, 2420 Isshiki, Hayama-machi, Kanagawa-ken, Japan

[21] Appl. No.: 92,791

[22] Filed: Nov. 8, 1979

[51] Int. Cl.[3] ..... F01B 13/06

[52] U.S. Cl. ..... 91/488

[58] Field of Search ..... 91/491, 488, 494, 495; 92/58

[56] References Cited

U.S. PATENT DOCUMENTS

| | | | |
|---|---|---|---|
| 3,223,046 | 12/1965 | Eickmann | 91/488 |
| 3,255,706 | 6/1966 | Eickmann | 92/58 |
| 3,277,834 | 10/1966 | Eickmann | 91/486 |
| 3,828,653 | 8/1974 | Aldinger | 91/488 |
| 3,951,047 | 4/1976 | Eickmann | 91/488 |

FOREIGN PATENT DOCUMENTS

| | | | |
|---|---|---|---|
| 1217713 | 3/1966 | Fed. Rep. of Germany | 91/491 |
| 79213 | 10/1930 | Sweden | 91/491 |
| 1459727 | 12/1977 | United Kingdom | 91/488 |

*Primary Examiner*—William L. Freeh

[57] ABSTRACT

In a radial piston pump, motor, transmission the deep diving or entering piston shoe is utilized and swingably borne in the pivot-bed of the radially reciprocating piston.

Since deep diving piston shoes have large piston strokes, the shoes pivot in the pistons in large angles.

Thereby a considerable force-portion of the load on the piston is transfered to the wall between the piston and the cylinder, whereby heretofore short pistons produced occasionally welding and sticking between the cylinder wall and the piston wall.

The piston therefore receives radially extending portions, which may extend beyond the medial portions of the piston show and may even enter into the ring groove of the piston stroke actuator ring. Thereby a very long guidance of the piston on cylinder wall portions is obtained, which makes the application of effective pressure balancing pockets at correct location between piston wall and cylinder wall possible. An extended piston guide and friction—less travel of the piston in the cylinder without wearing or sticking is assured.

27 Claims, 31 Drawing Figures

Fig. 1-B
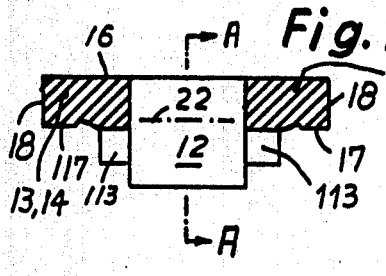
Fig. 1-A
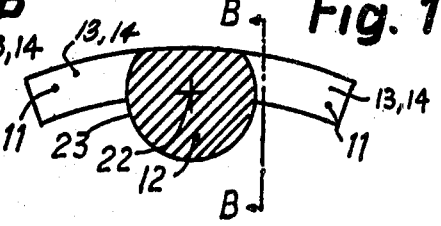
Fig. 1-C
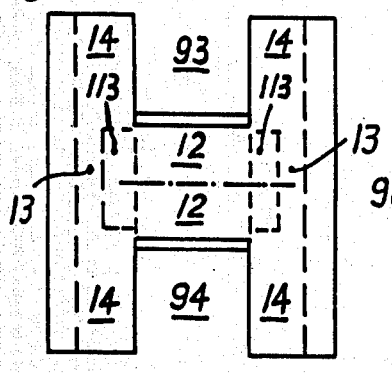
Fig. 2
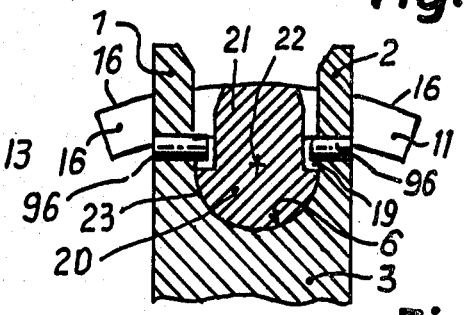
Fig. 3
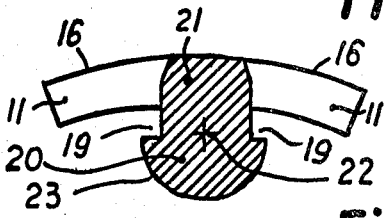
Fig. 5
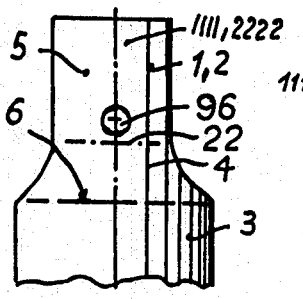
Fig. 4
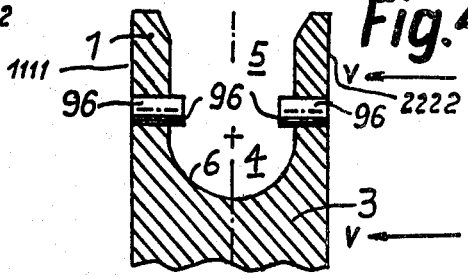
Fig. 6
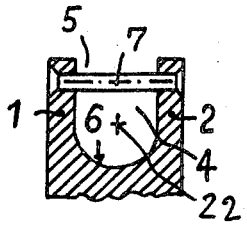

Fig. 7

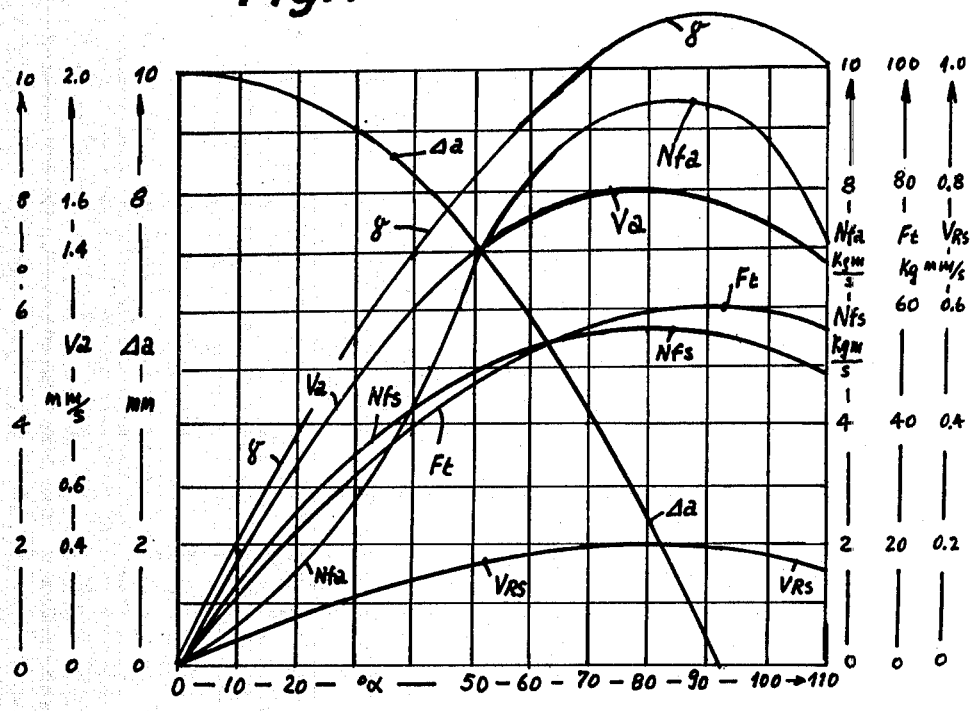

α = Rotary angle of piston axis from outer dead point = zero.

γ = Angle of pivotion of piston shoe in piston.

Δa = Radial inward movement of piston.

Va = Radial inward velocity of piston.

$F_T$ = Tangential = lateral force of piston wall onto cylinder wall $V_{RS}$ = Pivot-velocity = relative velocity between faces 6 and 23.

Nfa = Friction loss at travel of piston along cylinder wall when no tangential balancing pockets 71,72,54,55 are applied and when friction factor of mostly dry friction is $\mu p$ = o,20.

Nfs = Friction loss at pivot-motion between faces 6 and 23 of piston and pivot-portion of shoe, when half-dry friction factor if $\mu s$ = o,10 because no or too unsufficient balancing pockets 59,60 are applied.

Above values are valid for :
100 Kg/cm$^2$ pressure; 1500 upm; piston diameter = 20 mm and inner diameter of actuator ring is da = 130 mm; piston stroke is 20 mm at 180 degrees rotation alpha; according to Rotary Engine Kenkyusho Report RER-7906 .

31
1026
30
1026
12
32
34
35

ACTUATOR GROOVE
124
29
27
28
1
12
53
25
ROTOR
α
PISTON
C
26
e
16
2
14
24
43
4,6,23
11,12
34
35

1026
1026
1111
21
16
20
2222
35
34
22
2
29

124
124
34
35
124
28
1026
27
1111
1
21
20
63
25
C
shoe
γ
16
5
22
2
1026
2222
e
24
26
63
4,6,23
20
29
124
27
34
28
35

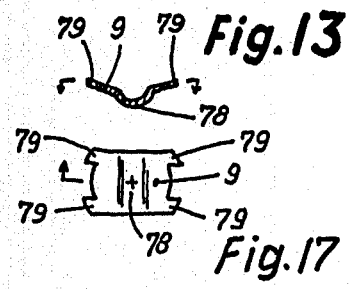
Fig.13
79
9
78
Fig.17
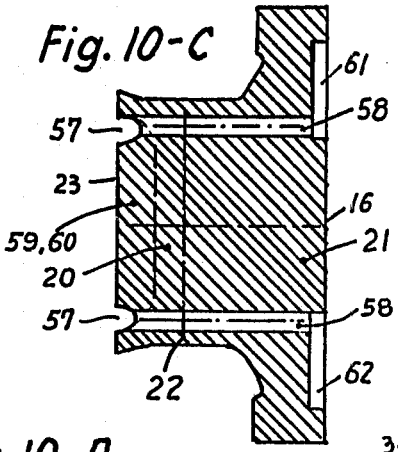
Fig. 10-C
61
58
57
23
16
59,60
21
20
22
62
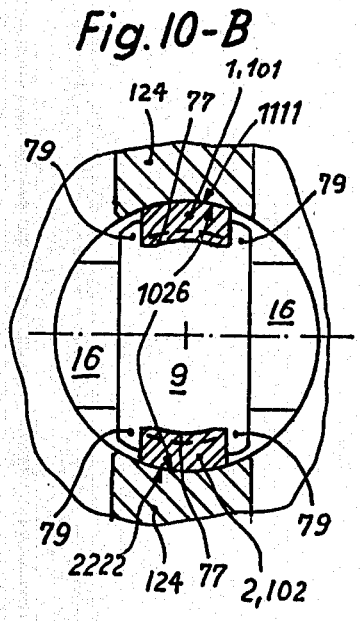
Fig. 10-B
1,101
124
77
1111
79
1026
16
9
2222
2,102
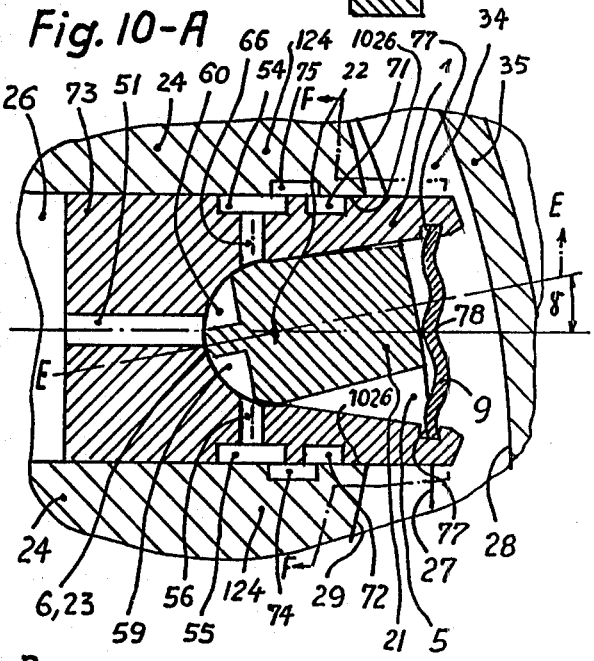
Fig. 10-A
66
124
1026
77
34
26
73
51
24
60
54
75
22
71
35
E
78
9
1026
24
6,23
59
56
55
124
74
29
72
21
5
27
28
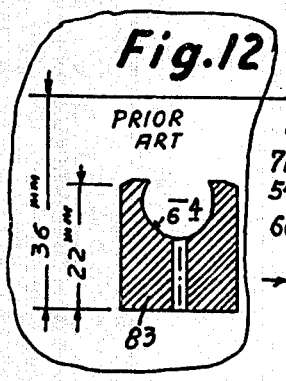
Fig.12
PRIOR ART
36 mm
22 mm
83
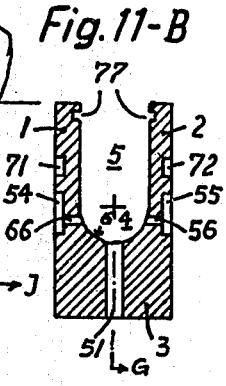
Fig.11-B
77
1
2
71
5
72
54
55
66
56
J
51
G
3
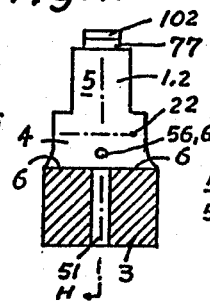
Fig.11-A
102
77
5
1,2
22
4
56,66
6
6
51
H
3
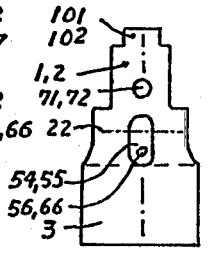
Fig.11-C
101
102
1,2
71,72
22
54,55
56,66
3

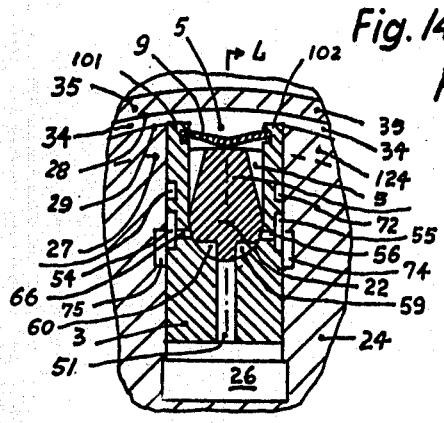
Fig. 14-B
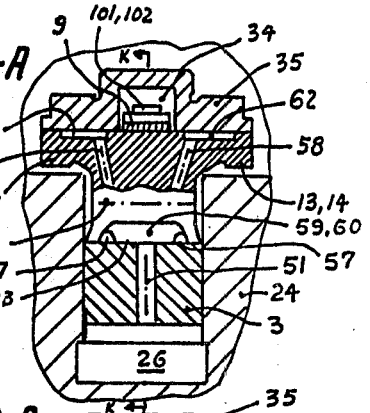
Fig. 14-A
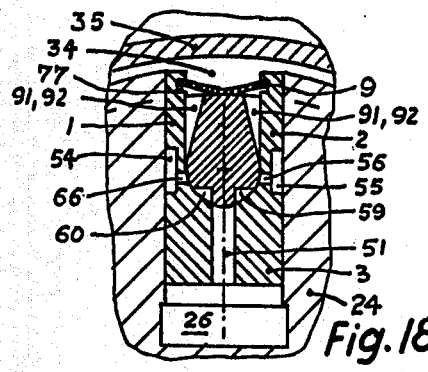
Fig. 18-B
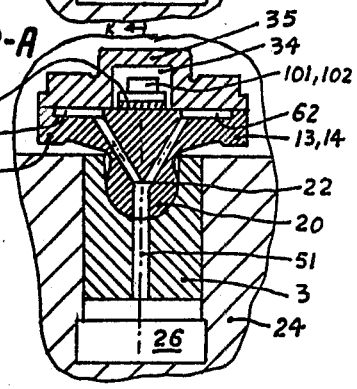
Fig. 18-A
Fig. 15-B
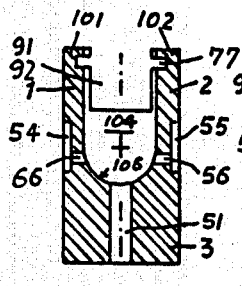
Fig. 15-A
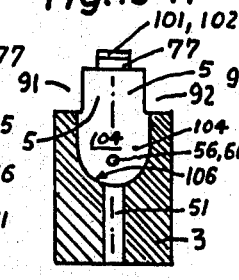
Fig. 15-C
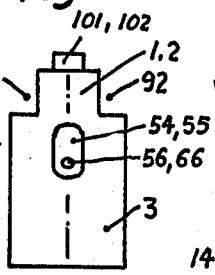
Fig. 16-B
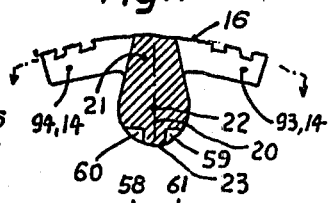
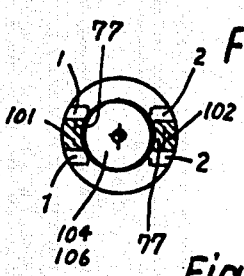
Fig. 15-D
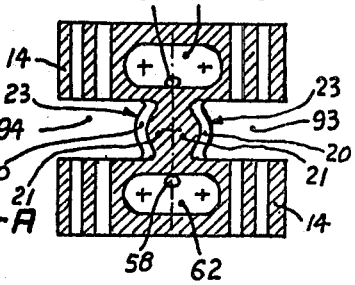
Fig. 16-A
Fig. 19-B
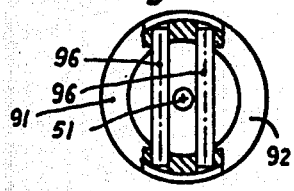
Fig. 19-A
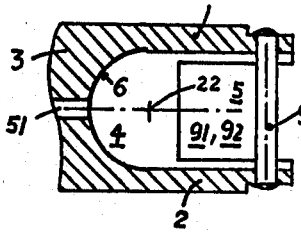
Fig. 19-C
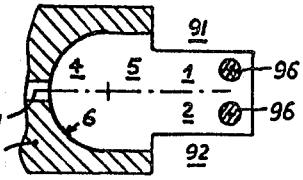

RADIAL PISTON MOTOR OR PUMP

BACKGROUND OF THE INVENTION

Radial piston devices have outer piston shoes which do not enter into the cylinder. That is the common design of past and present. In my U.S. Pat. No. 3,223,046 the entering piston shoe was introduced, which elongated the piston stroke and thereby increased the power of the device of equal outer diameter and weight. It did so by partially entering the piston shoe into the respective cylinder through the form of an "H" of the piston shoe's outer portion.

My U.S. Pat. No. 3,277,834 thereafter introduced the "deep-diving" piston shoe. The deep diving of the piston shoe further extended the stroke of the piston of a device of a given diameter and weight and thereby drastically increased its power still further. This success was reached thereby, that the piston stroke actuator ring obtained an inner annullar groove for the reception of the outer portions of segments of the rotor. The "H-formed" deep diving piston could thereby fully enter into the respective cylinder beyond the outer diameter of the outer rotor portions. The increase in power of the devices of given diameter and weight increased so drastically thereby, that the power of a device of given dimension and weight multiplied.

Over the years of intensive research these devices with deep diving piston shoes were improved to deliver more and more power per unit size. Especially they were also developed as motors. Motors can succeed only with the very large piston strokes compared to the inner diameter of the actuator ring, which is called "da". The relation of stroke "s" to said "da", namely the relation S/da defines basically the power and quality of such a device.

With the ever increasing power and strokes the guide-length of the piston did however not increase enough. That led, as is now discovered, thereto, that the piston's outer end is pressed stronger against the wall of the cylinder, than the inner end of the piston, because of the location of the swing point or swing axis of the pivotion assembly of piston and piston shoe in the neighborhood of the outer end of the piston.

THE AIMS AND OBJECTS OF THIS INVENTION

By this invention it is recognized, that the deep diving piston-shoe assembly forces the outer portion of the piston under tangential force-portions of the load by the pivoting action of the shoe in the piston stronger against the wall of the respective cylinder, than the inner portion of the piston.

That is so, because the swing—or pivot centre is located relatively outward, radially outward in the respective piston. When it would be transfered radially more inward into the piston, the angle of pivotation would still become bigger and the piston shoe portions outward of the pivot-centre would become longer, whereby the medial outer portion of the piston shoe would become too thin and the tangential force portion under the bigger angle of pivotation would become too great for best operational results.

It is therefore the aim of the invention to prevent locally stronger pressing between cylinder wall and piston wall than appears at other locations.

The next aim of the invention is, to lay the swing- or pivote centre as far as possible into the middle of the guide-portion of the piston on the cylinder wall.

Another aim of the invention is, to provide space for effective fluid pressure pockets between piston walls and cylinder walls at the correct location;

and a still further aim of the invention is, to provide a still longer piston guide on the respective cylinder wall portion.

To reach these aims, the invention provides the following solutions or objects, whereby it is further attempted and assured, that these means, objects, solutions are able to be made with best and as far as possible, less expensive manufacturing methods.

(a) The piston obtains radial extensions, which at least partially embrace the medial portion or the pivot-portion of the piston shoe.

Thereby the piston guide is radially extended, because the respective piston portion, namely the extension, provides the longer guide on the cylinder wall portion.

(b) To fasten the piston shoe pivot-portion on said extensions of the pistons.

Thereby the heretofore expensive partially embracement of the pivot portion of the piston shoe radial outwards of the pivot-centre is prevented and spared. The piston shoe can now become pressed or cast and can be machined with radii extending over surfaces of less than 180 degrees or maximally 180 degrees, which eases the machining procedures very effectively and reduces the costs of the piston shoes to a fraction of the former piston shoes.

(c) The radially extended portions of the piston may be extended beyond the outer face of the piston shoe, so, that at certain locations of revolution of the rotor they enter into the annullar inner ring groove of the piston stroke actuator ring.

Thereby the maximum of possible length of radial guidance of the piston in the cylinder is obtained.

Further obtained thereby is, that the outer portion of the piston becomes practically substantially as long as the inner portion of the piston shoe is. The lateral force portion or tangential force portion of the load on the piston, which appears, when the piston shoe pivotes out of the neutral position acts almost exactly in the middle of the piston. Best load division is thereby obtained, welding between piston and shoe is reduced and a location is provided, where fluid pressure balancing pockets can be set at best effective place, namely in the middle of the radial length of the piston. and;

(d) The piston - shoe may be fastened or retained in the piston by simple retaining means, provided radially outward of the piston shoe in the piston - extensions, whereby they become located within the annullar ring groove of the piston stroke actuator ring.

Thereby the expensive fastening of the pivotable piston shoes in the pistons of the past is spared and the costs of the piston shoes are drastically reduced. The manufacturing times are decreased.

The invention, thus, provides a radial piston device with better and longer piston guide and more effective be of the piston in the cylinder with less friction between the walls of pistons and cylinders. It thereby increases the power of a device of a given dimension and weight. It further reduces the costs of manufacturing of the piston shoes and it makes the device more reliable over an extended life time by said longer and better guide of the piston portion on the respective cylinder wall portions. It obtains all these features without increasing the weight or size of the device.

FIG. 1-A shows a cross-sectional view through the middle of an embodiment of a piston shoe of the invention.

FIG. 1-B is a sectional view through FIG. 1-A along the arrow B—B of FIG. 1-A.

FIG. 1-C is a view from top onto the piston shoe of FIG. 1-B.

FIG. 2 is a longitudinal sectional view through an embodiment of an assembly of a piston with the piston shoe of the invention therein.

FIG. 3 is a cross-sectional view through the piston shoe of FIG. 2, and the piston shoe is separately demonstrated in this FIG. 3.

FIG. 4 is the longitudinal sectional view through the piston of FIG. 2 and the piston is separately shown in this FIG. 4.

FIG. 5 shows a view onto the piston of FIG. 4 seen along the arrow V—V of FIG. 4.

FIG. 6 demonstrates another fastening method on a piston in a longitudinal sectional view through a portion of the piston.

FIG. 7 demonstrates a schematic of strokes, inclinations, forces and the like in an actual device of the invention.

Figure 8:
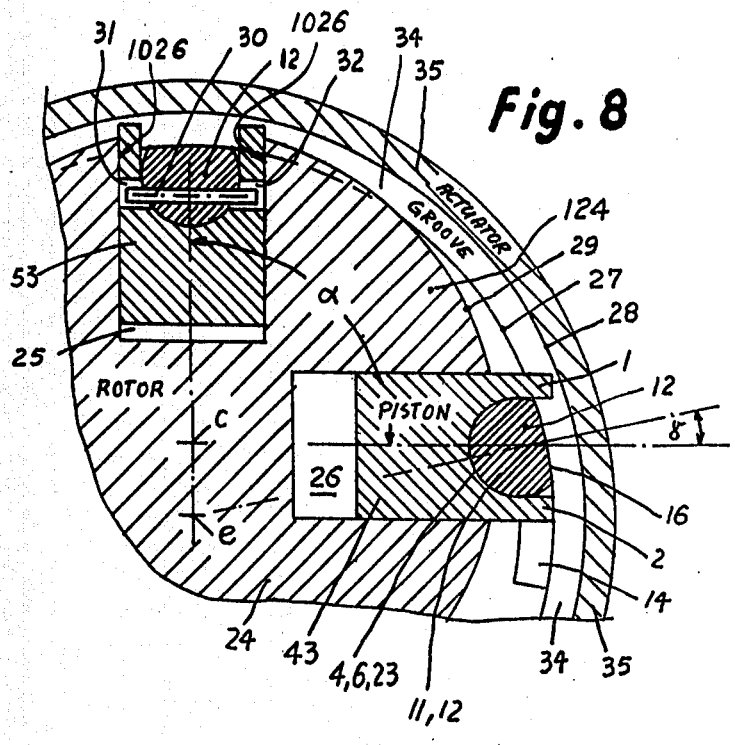

FIG. 8 shows the piston shoe of FIG. 1 as shown in FIG. 1-A, assembled in a portion of a radial piston motor and is a cross-sectional view through a portion of such motor.

Figure 9:
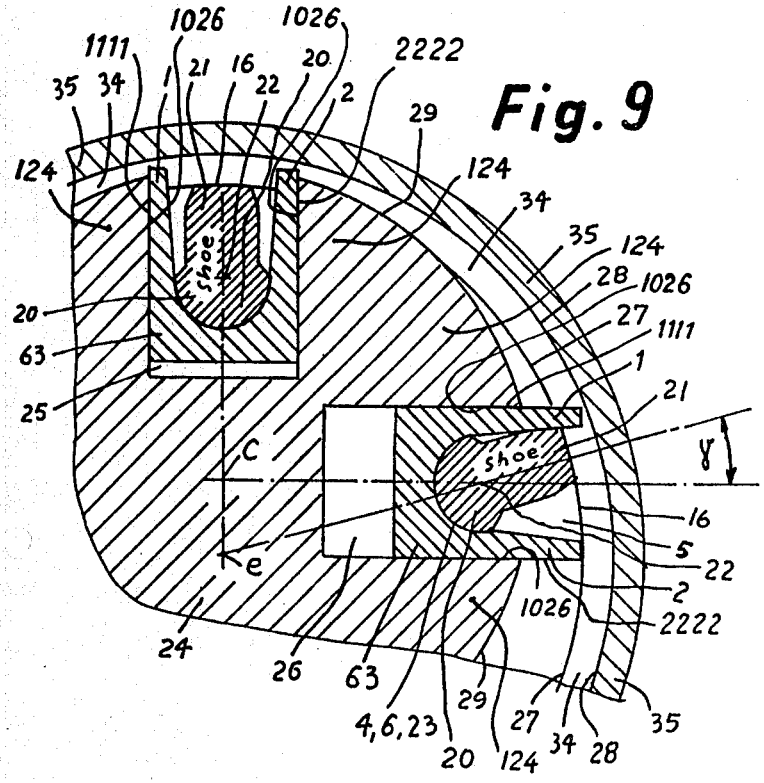

FIG. 9 shows for comparison such assembly of a piston shoe in a pump for comparison with the motor and is a cross-sectional view through a portion of such pump.

FIG. 10-A is a cross-sectional view through a most advanced portion of a pump or motor with a piston and piston shoe assembly of the invention therein.

FIG. 10-B is a sectional view through FIG. 10-A along the arrow F-F.

FIG. 10-C is a sectional view through the piston shoe of FIG. 10-A along the arrow E—E of FIG. 10-A.

FIG. 11-A is a longitudinal sectional view through a piston of the invention.

FIG. 11-B is a sectional view through FIG. 11-A along the arrow H.

FIG. 11-C is a view onto the piston of FIG. 11-A seen from arrow J of FIG. 11-B.

FIG. 12 is a sectional view through a piston of the prior art for comparison.

FIG. 13 shows a retaining means in a cross-sectional view.

FIG. 17 shows the retaining means of FIG. 13 seen from above.

FIG. 14-A is a longitudinal sectional view through a radial piston device with a piston and a piston shoe of the invention assembled therein.

FIG. 14-B is a sectional view through FIG. 14-A along the arrow: K.

FIG. 15-A demonstrates a sectional longitudinal view through another piston of the invention.

FIG. 15-B is a sectional longitudinal view through the middle of FIG. 15-A.

FIG. 15-C is a view from the side onto the piston of FIG. 15-B.

FIG. 15-D is a cross-sectional view through extensions 1 and 2 along the grooves 77 of FIG. 15-B seen downwards in FIG. 15-B.

FIG. 16-B is a cross-sectional view through another piston shoe of the invention.

FIG. 16-A is a sectional view through FIG. 16-B along the arrow therein.

FIG. 18-A is a longitudinal sectional view through a portion of a radial piston device with the piston of FIG. 15-A and the piston shoe of FIG. 16-A assembled therein.

FIG. 18-B is a sectional view through the medial line of FIG. 16-A whereby the piston of FIG. 15-B and the piston shoe of FIG. 16-B is seen therein.

FIG. 19-A is a longitudinal sectional view through another piston of the invention.

FIG. 19-B is a cross-sectional view through FIG. 19-A, namely through the radial outer portion thereof along the axes of pins 96, wherein however the pins 96 are shown in a view onto them.

FIG. 19-C is a cross-sectional view through FIG. 19-A along the longitudinal centre line thereof, whereby the view also crosses the pins 96 therein.

DESCRIPTION OF THE PREFERRED EMBODIMENTS

In FIG. 1 the piston shoe 11, which is one of the embodiments of the invention is shown. The right FIG. 1-A is a cross-section through the left FIG. 1-B along the line A—A and the right FIG. 1-A is a cross-section along line B—B through the right FIG. 1-B of FIG. 1.

The piston shoe 11 has a medial portion 12. This is a part of a cylinder and can therefore be machined on a lathe machine or on a round grinding machine, which was not possible for the medial portions of my former patents. Thus, the medial portion of the piston shoe is simplified by this embodiment of the invention and it can now be easily machined.

The medial portion 12 is integral with the end-portions 13, which extend into the guide portions 14, whereby the entering or deep-diving piston shoe has the said "H" - Form in the view upon it in FIG. 2. The term "H-formed piston shoe" has become standard procedure at the West German patent office for the entering and deep diving piston shoes of the inventor.

The axial end-portions 13 and the guide portions 14 do not principially differ from my beforementioned earlier patents of the entering or deep-diving piston shoes.

However, for the radial stabilization of the piston shoe it is preferred to provide support portions 113 endwards of the medial portion 12 at least in a suitable axial extent.

The piston shoe further has the outer face 16 and the inner guide faces or the end-guide faces 17 and 18 may be provided, if so desired. The faces 16 to 18 are also known from my mentioned earlier patents and do not differ principially from the piston shoes therein. Portions 13 may have radial support portions 113. Thereby portions 113 extend axially from medial portion 12 to act as radial supports.

The piston shoe, shown in the sectional FIG. 3 is equal to that of FIG. 1 with the only one difference, that outcuts or depressions 19 are provided radially of the pivot-centre 22.

The reason for the provision of depressions 19 will become understood from the following description of FIG. 4.

FIG. 4 shows the piston 3 with its novel radial extension 1 and 2. It has the bearing bed 4 for the pivotable reception and bearing of the medial portion 12 of the piston shoe, for example of FIGS. 1,2. Shoe 11 swings or pivotes in bed 4 around pivot-centre 22.

Extensions 1 and 2 form outer face portions 1111,2222 respectively in the direction of the respective portions of the outer faces and outer diameters of the respective pistons 3 and they are guided at least partially by and sliding at least partially after their assembly into the respective rotor 24 along the respective wall portions 1026 of the respective radial extension segments 124 of the respective rotor 24 of my mentioned U.S. Pat. Nos. 3,223,046 or 3,277,834. The wall portions 1026 are also shown for example in FIGS. 8 to 10 and they are extending in the faces of the respective portions of the walls of the respective cylinders 26 radially outwards from the respective cylinder 26.

The extensions 1,2 which are also visible in FIG. 5, are novel portions of the invention.

A further novel matter of the invention is, that the retainer members 96 may be applied in the extensions 1 and 2, after the assembly of piston shoe 11 into piston 3. These retainers 96 will then enter into the depressions 19 of piston shoe 11, whereby they retain the piston shoe within the piston, allow the piston shoe to pivot in the piston, but retain the piston shoe from escaping out of the piston.

The piston shoes medial portion 12 of the piston shoe of FIG. 3 has therefore a bottom portion 20 of wider extension and an upper portion 21 of smaller lateral extension. The depressions 19 are formed on the upper portion and may end about in a radial height equal or close to the medial pivot-centre 22.

The piston shoes of FIGS. 1 to 3 can now be forged or cast or pressed, because any embracement over more than 180 degrees as in my former patents, is spared and faces with equal radii of less than 180 degrees around a centre can be cast, pressed, forged or machined even with surface grinding machines and formed grinding wheels. The piston shoes of the new system are therefore very inexpensive and can be easily and quickly produced.

The described retaining assembly does not necessarily force the inner face 23 of the respective piston shoe for close engagement on the surface of the bearing bed 4. But it can be forced to such engagement by addition of other retaining means of others of the figures. However, such forced engagement of faces 23 on the bed 4 is not always required, because at the pressure strokes in the device the pistons force themselves against the faces 23 of medial portions 12, whereby the faces 23 are closely sealing and bearing in beds 4 of pistons 3. This said "forcing themselves" is obtained by the pressure below the bottom of the respective piston in the respective cylinder at the high-pressure stroke of the respective piston 3.

The referentials 1 to 23 are basic referential numbers, which cite parts or portions, which will repeat in many of the later figures. They will get a pre-digit in other figures or may appear in other figures without a further pre-digit. But in the description of the other figures, the pre-digit will be left out. That means, that regarding referential numbers 1 to 23 only the one or two end-digits will be mentioned in the description of the other figures. Because thereby it will be easier visbile and understandable, that the respective parts, portions, or faces, centres and like of the other figures have basically equal functions as in FIGS. 1 to 5. FIG. 2 demonstrates the assembly of the piston shoe of FIG. 3 into the piston of FIG. 4, whereby the entering of retaining members 96 into the depressions 19 becomes visible.

In FIG. 6 another retaining means for the holding of the piston shoe in the bed in the piston is demonstrated. In this figure a pin means 7 is inserted into piston 33 at a radial height slightly above the outer face 16 of the respective piston shoe 11. Pin means 7 extends from piston extension portion 1 through the opening gap 5 of the pivot bed 4 into or through piston extension portion 2. Thereby the retaining of the piston shoe in the pivot-bed 4 of the piston with end digit 3 is assured.

As seen from FIG. 4, the piston's pivot - bed 4 has a bearing bed surface 6 of a configuration of a face with equal radius around a common centre 22. Such centre may be a centre line or a centre point 22. The bearing face 6 of equal radius around centre 22 may be a part-cylindrical face with equal radius around a centre line 22 or it is a part-ball-formed face with an equal radius around a centre point 22.

In FIG. 8 rotor 24 contains cylinders 25 and 26 in that portion of the rotor, which is shown in the figure. Piston 43 reciprocates in cylinder 26 and piston 53 reciprocates in cylinder 25. In piston 43 the piston shoe 11 of FIG. 1 is pivotably borne in bed 4 without mechanically provided retaining means. It is kept in bed 4 simply by the pressure of fluid in cylinder 26. Such pressure forces the piston 43 outwards, whereby the face 6 of bed 4 automatically engages the pivot face 23 of medial portion 20 of the piston shoe 11.

Referential 27 shows the piston stroke actuator guide face. 29 is the outer diameter of the rotor segments 124 of rotor 24. The annular ring groove 34 of the piston stroke actuator ring extends from inner faces 27 to the outer face 28 of the groove in piston stroke actuator 35. It is seen in this portion of the figure, that the extensions 1 and 2 of piston 43 extend in operation of the device radially beyond the outer face 16 of piston shoe 11 into the said annular ring groove 34 of the actuator 35.

Piston 53 shows another embodiment of a retaining means for holding piston shoe 11 in the bed 4 of the piston 53. In this embodiment a pin 30 is inserted through the inner portion 20 of the medial portion 12 or through the medial portion 12 of the piston shoe 11. The said retaining pin 30 extends beyond the said medial portion 12 into recesses 31 and 32 in the extension portions 1 and 2 of piston 53. The recesses 31 and 32 are slightly wider in cross-sectional area, than the respective cross-sectional area of the pin means 30 is, in order to permit the pivot-movement of the piston shoe within the piston bed 4. The cross-sectional area of recesses or slots 31,32 is however so located and dimensioned and resticted, that the pin ends of pin 30 can not move too much radially outward. Thereby the piston shoe 11 is also by this retaining means of the invention effectively contained within gap 5 and bed 4 in piston 53.

The embodiment of FIG. 8 is especially convenient for application as a motor. Because the lateral or tangential component of forces than acts at a great radial distance from the centre of the rotor against the cylinder walls. That gives relatively slight forces onto the cylinder walls, but provides a great torque.

The embodiment of FIG. 9 may also be used as a motor, but it is also suitable to be used as a pump. The difference compared to FIG. 8 is, that the pivot-centre 22 in FIG. 9 is located deeper in the pistons than in FIG. 8. The pivot centres 22 of pistons 63 of FIG. 9 are thereby closer to the centre axis of rotor 24 than in FIG. 8 and consequently the arms of the torque-action are shorter. The tangential forces onto the cylinder walls are therefore higher than in the embodiment of FIG. 8.

An analysis of pumps and motors will show, that both are equal devices, acting just in the reversed way. It would therefore appear on first glimpse, that the same devices of equal parts and dimensions can be used as pumps as well as also as motors. And, this assumption is in fact true.

When however, the highest quality of a device is desired, such assumption on first glimpse is not absolutely true any more. Because in a pump the piston moves radially inwardly at its pressure stroke or power stroke. But in a motor the piston moves radially outwardly at the pressure and power stroke. In those devices, where the swing or pivot-centre 22 is in the middle of the acting guide face length of the piston on the cylinder wall, the actual actions between the piston wall and the cylinder wall are equal in pumps and motors. But, when the pivot-centre 22 is not in the middle of the guide face length of the piston, the matter becomes different.

When in a pump, the pivot-centre is too much inwards of the piston, the lateral forces will too strongly press the inner corners of the pistons against the cylinder walls and wear and weld there. When in a motor the pivot-centre is too much radially outward in the piston, the outer corners of the pistons will be pressed under the lateral forces too strongly against the cylinder wall portion and they will wear there and finally weld there.

It is this basic consideration, which discovers, that in the devices of the former deep diving piston shoes, the guide faces of the pistons were too short radially outward of the pivot-centres 22 of the pistons, whereby the described wearing and welding of the outer corners of the pistons could occur in motors.

Consequently, the gist of the invention is, to elongate the guide face of the piston on the cylinder wall portion drastically radially outward of the pivot-centre 22. The invention does so by providing the piston extensions 1 and 2 and by extending them radially outwardly beyond the pivot-centre 22 and in the embodiments of the FIG. 8 also into the annular ring groove 34 radially beyond the outer face 16 of the piston shoe 11.

In FIG. 9 the extensions 1 and 2 may also be an integral extension 1, surrounding a ball-part formed portion 20 of the piston shoe. Portion 1 or portions 1 and 2 extend in such a case, (not illustrated in figure) only radially outwards beyond the pivot—centre 22 but not into the annular groove 34 and not beyond the outer face 16 of the piston shoe. The consequence thereof is, that the device of FIG. 9 is applicable to highest pressures and speeds only in a pump. In motors its application is restricted to slightly higher than medial pressure in fluid, for example about 4000 psi. The simplicity of manufacturing and the possibility to operate without a retaining means however leads to use of this device also as motor as far as the said medial pressure in the motor is satisfactory.

FIG. 10 demonstrates in three sectional views 10-A to 10-C with views 10-B and 10-C taken along the arrows in FIG. 10-A respectively an embodiment of the invention for application in the highest advanced technology motor. It may also be used in a pump. Cylinder 26 contains the therein reciprocating piston 73. The piston extension portions 1 and 2 extend beyond the pivot-centre 22 and beyond the piston shoe's outer face 16 into the annular ring groove 34 of piston stroke actuator 35. This embodiment has a novel retaining means 9 in the form of a spring-plate inserted into groove portions 77 provided in extensions 1 and 2. Spring plate 9 may have a medially inwardly directed portion 78 to press flexibly against the outer face 16 of the piston shoe to maintain close contact between faces 6,23. Spring plate 9 may also have extensions 79, visible in the left portion of the figure, in order to embrace narrower outer extensions 101 and 102 of extensions 1 and 2 in order to prevent rotation of the spring plate 9 relatively to the piston and the piston shoe.

Another feature of the invention of this embodiment is, that, when the extensions 1 and 2 extend into the ring groove 34, they are prevented from rotation. That means, that the piston can not rotate around its axis. The same effect is also already obtained, when the extensions 1 and 2 extend beyond the pivot-centre 22. Because then, since the piston shoe can not rotate, the entrance of the extensions 1 and 2 into the recesses of the "H" of the "H-formed" piston shoe prevents rotation of the piston relatively to the piston shoe and thereby also prevents rotation of the piston around its axis.

The described prevention of rotation of the piston 3 around its axis makes it possible to accurately provide fluid pressure balancing pockets between the piston wall and the respective portion of the cylinder wall. These fluid pressure pockets take over the major portion of the lateral, tangential load which is exerted by the pivot-motion of the piston shoe over the piston onto the cylinder wall.

The figure shows, that these fluid pressure pockets, which are recesses which are filled with pressure fluid, are located in the figure exactly in the middle of the radial guide of the piston.

Pressure in fluid enters through piston passage 51 into recesses 59 or 60 respectively, depending on the pivot-direction of the piston shoe. Recesses 59 and 60 are also radial fluid pressure balancing recesses which take over a large portion of the radial forces between piston 73 and shoe portion 20. They are communicated by the outer recesses 57, visible in the upper portion of the figure. When recess 59 or 60 communicates with passage 56 or 66, the fluid and its pressure is led either into tangential balancing fluid pressure pocket 54 or 55. These pressures either in fluid in recess 54 or 55 provide forces which are about equal, but oppositionally directed, relatively to the force exerted by the lateral component of fluid pressure forces under the pivot-angle of the piston shoe onto the piston. The communication between passages 56 or 66 and pockets 54 or 55 starts, according to design, about at 40 to 50 degrees rotary angle alpha of the rotor. One of the pockets 54 or 55 becomes loaded with high pressure and the other is excluded from high pressure supply. That is required to direct the force of fluid into that portion of the piston which is pressed toward the respective cylinder wall by the respective angle of inclination of the piston shoe at its pivoting motion.

The piston 73 may also be provided with secondary balancing recesses or fluid pressure pockets 71 and- or 72. When they are provided, then communication passages 74 and 75 are precisely set into the respective walls of the cylinders. The function of such provison is, that, when the rotary angle alpha of the rotor increases to about 75 to 105 degrees, the lateral thrust component of the forces on the piston increases further, because the inclination angle gamma of the pivoting shoe increases steeper.

The schematic FIG. 7 shows the results of calculation of the strokes, inclinations, etc. of a sample of a radial piston device. Therefrom it is seen, that the lateral forces of the piston increase towards about 45 degrees to become extensive there and that they increase further towards about alpha ninety degrees to become a maximum there.

The communication passages 74 and 75 are now provided at a radial distance from the centre axis of the rotor, that they start to communicate recess 54 with secondary recess 71 or recess 55 with secondary recess 72 at rotary angles alpha from about 75 or 85 to about 95 or 105 degrees. Thereby the first recesses 54, or 55, in combination with the secondary recesses 71 or 72 take over the peak of the lateral forces of the piston at the peak occurance around the 90 degrees rotary angle alpha.

At other rotary angles alpha the communication to the secondary recesses 71 or 72 does not exist, so, that at other rotary angle alpha the recesses 71 and 72 are not loaded with high pressure fluid and therefore are not or not fully acting. Instead of providing first and secondary fluid pressure balancing recess pairs 54,55 and 72,71 it is also possible to set pluralities of higher number of such tangential balancing recesses and a respective plurality of communication passage pairs 74,75. As more such steps are set as closer the take over of lateral forces nears the stepless and perfect take over of the lateral, tangential forces of the pistons. Costs of producing the recesses and communication passages however leads in practical application to only one or two recess pairs, when no complete stepless or almost stepless take over of lateral forces by fluid pressure pockets is required.

The top portion 10-C of the figure is a cross-sectional view through the bottom right FIG. 10-A along line E. It shows the respective configuration of the piston shoe in the presently most advanced form, containing also the passages 58 which lead the pressure fluid into the balancing pockets 61 an 62 in the outer face 16 of the piston shoe to prevent wearing between the actuator ring inner face(s) 27 and outer face 16 of the piston shoe.

The bottom left portion 10-B of FIG. 10 is a cross-sectional view through the bottom right portion 10-A along line F in order to see clearly the configuration of spring retainer 9, the narrowed portions 101 and 102 of extensions 1 and 2, to see the extensions 79 which embrace portions 101 and 102 in order to prevent rotation of retainer 9 and in order to see, that the top-piston assembly remains axially seen within the axial extension of the rotor extension segments 124, whereby they remain narrow enough to remain within annular groove 34.

FIG. 11 shows in three views 11-A to 11-C the piston 73 of FIG. 10 in a separate demonstration to show the members described at hand of FIG. 10 more clearly.

The figure is shown in a 1:1 scale for a 42 cc motor. Medial portion 11-A is a section along line G—G of the left portion 11-B. The left portion 11-B is a sectional view along line H—H of the medial portion 11-A and the right FIG. 11-C is a view onto the left portion 11-B along view J—J.

FIG. 13 shows an example of the spring plate or retainer means 9 in a separated view. The FIG. 13 is a section through it and the bottom figure, namely FIG. 17, shows a view from top onto it.

FIG. 12 is a longitudinal sectional view through a piston 3 of my former art technology. It is again drawn in a 1:1 scale for a 42 cc motor for comparison with the novel piston of the invention. The guide length of the piston of FIG. 12 of my former technology is 22 mm compared to a guide length of 36 mm for my novel piston of FIG. 11. That gives an elongation of the piston guide of 36:22=1,65 times elongation of the guide length of the novel piston of the invention compared to the piston of the former art.

In FIG. 14 the piston and shoe of FIGS. 10 and 11 is assembled into a radial piston device for 42 cc/revolution in a one to one scale. The right portion 14-A of the figure is a section along line L—L of the left portion 14-B and the left portion 14-B is a sectional view through the right portion 14-A of the figure along the line K—K. The respective referentials which are known from the description of the earlier figures are shown in the figure to demonstrate their locations in a radial piston fluid handling device. The functions and configurations of the portions, parts and like are already known from the description in the earlier figures.

The piston of FIG. 15 is similar to that of FIG. 11 and shown in the same scale and sections or views for a 42 cc motor with the one difference, that the piston of FIG. 11 has a part-cylindrical pivot-bed 4, while the piston of FIG. 15 has a part-part-ball-formed pivot-bed 104. Accordingly the piston shoe of FIG. 16, which can be assembled into or laid into piston of FIG. 15, has a part-ball-formed inner pivot-portion 120 instead of the part-cylindrically formed portion of FIG. 14. Important is, that the piston of FIG. 15 requires outcuts 91 and 92 in order to be able to extend through the slot of the "H-form" of the piston shoe and into the annular ring groove 34 of the actuator ring 35.

The piston shoe of FIG. 16, shown in sectional view FIGS. 16-A and 16-B with FIG. 16-A being taken along the arrowed line of FIG. 16-B, which can be laid or be assembled into the piston of FIG. 15, shows the outcuts or recesses or slots 93 and 94 which form the "H" of the entering or of the deep diving piston shoe of my earlier patents.

What matters in this present invention, is, that the radial extensions or portions 1,2 of the piston can extend through slots 93 and 94 of the piston shoe of FIG. 16 and pass with their outer ends 1,2 and 101,102 beyond the outer face 16 of the piston shoe of FIG. 16.

The bottom FIG. 15-D of FIG. 15 is a view from top upon the left portion of FIG. 15 in order to clearly make visible the narrower portions 101 and 102 in relation to the extensions 1,2 and in relation to the pivot bed 104 with face 6.

In FIG. 17 a respective retaining spring plate is shown. As already explained at the description of FIG. 13.

In FIG. 18 the piston and piston shoe of FIGS. 15 and 16 are assembled into a respective portion of a radial piston device. Again, this figure is shown in a 1:1 scale for a 42 cc/revolution device with 7 pistons of 20 mm diameter each. The scale can be obtained from the reduced scale patent drawing by comparing the 22 mm and the 36 mm of FIG. 12. Figure portions 18-A and 18-B are sectional views along the medial lines of the other figure portion respectively.

In FIG. 19 three sections, namely figure portions 19-A to 19-C through the radial outer portion of another embodiment of the invention demonstrate a plurality of retaining pins assembled into the outer portion of the respective piston. Pins 96 extend into the extensions 1,2 and through the gap 5, whereby they retain the respective piston shoe in the gap 5 or in the pivot-bed 4.

It can also be recognized from FIG. 19, that the outermost portion of the piston does not need a guide face on the cylinder wall and can be reduced in diameter, if so desired, in order to prevent friction or scratching of the ends of pins 96 on the cylinder's walls. That gives space for rivetting of the pins 96 on the extensions 1,2 of the respective pistons. However, such rivetting is not shown in the figure, because it is not in all cases of practical application required.

As will be seen from the references of the former art, the piston shoes of axial and radial piston devices are sometimes called "piston shoes" and in other literatures are also called slippers. The rotors of radial or axial piston devices are sometimes called "rotors" and in other literatures called "barrels". The terms "piston shoe" and "slipper" shall therefore define equal elements in the specification or claims and the term "rotor" in the specification and claims shall be the equivalent of the term "barrel" of the respective literatures as far as the structures are not in detail defined differently in the specification and figures. The term "pivoting" also means "tilting"; "tiltable" means "pivotable".

FIG. 7 gives the actual data of tangential force, friction losses, pivot-angle gamma, movements of pistons and of pivoting in a schematic, but accurate diagram for the values written in the figure.

It may be appreciated, that these values show with overwhelming impression, how important the losses due to friction in the pivot-faces and at the movement of the piston wall along the cylinder wall are.

That these losses, except in some of my earlier patents are heretofore neglected, is perhaps the consequence of the fact, that axial piston devices with inclined plates obtain only small piston strokes and that those radial piston devices which were studied by big enterprises at the inventor's research institute in the early sixties by big corporations, neglected his patents and built around them, which restricted those leading enterprises to short piston strokes in radial piston devices which they are building and selling since the early seventies. The refusal to buy licences of patents of advanced technology by the industries led to inferior devices which neglected the requirements of the lateral fluid pressure balancing recesses of my inventions and therefore to the supply of inferior products in this respect to the industries, to the customers and to the public. Since according to this invention, the lateral friction losses between the piston and the cylinder wall can be reduced to a very small or neglectible remainder, it is sure, that the devices of this invention are technologically superior in efficiency, life time or power to devices of axial piston types with inclined plates as piston stroke guides and naturally also superior in power and efficiency to those newer designs, which tried to copy or to improve my inventions of the early sixties and thereby brought products in the early seventies, which neglected the fluid pressure pockets between the piston wall and the cylinder wall and which neglected the need for a long stroke at a given size of the piston stroke actuator by the application of the entering or of the deep diving piston-shoe. And, which also neglected the requirement of a long piston guide as in my earlier patents and as specifically provided for by this present invention.

It should also be recognized, that the angle of inclination of pivoting and thereby the resulting lateral forces of the pistons are greater the deeper the pivot-centre is located inside the piston. This is seen for example from FIGS. 3 and 9. The extensions of the invention make it possible to transfer the said pivot-centre more radially outward, whereby the resulting lateral forces are decreasing in principle.

What is claimed is:

1. In a radial piston device, wherein fluid flows from inlet means through passages into and through substantially radially arranged cylinders of a rotor revolvably mounted in a housing of said device and discharges out from said cylinders through passages and outlet means, the combination of pistons reciprocating in said cylinders, slippers interposed between a piston stroke actuator means and the pistons, a slipper-piston bearing for each individual piston and slipper located parallel to the axis of rotation of said rotor which makes said slipper tiltable and pivotable on the respective bearing bed in the respective piston;

an "H-form" of each individual slipper when seen from top, having slots between the guide portions of said slipper laterally of said slots;

each individual cylinder of said cylinders provided with wall-portions which extend from portions of the wall of said cylinder in the directions of said respective portions of the wall of said cylinder along respective radial extension segments of said rotor; and an improvement;

wherein said improvement consists in the provision of radial extensions of portions of said pistons in radially outward direction relative to said rotor, wherein said extensions are located perpendicular to the axis of said slipper-piston bearing and at least partially outwardly of said rotor, wherein retaining means are provided between said extensions and radially outwardly of a portion of said slipper for holding said piston and slipper in a joint and tiltable disposition, and;

wherein said extensions form face portions extending from the outer face of said piston in the direction of the respective portion of said outer face of said piston to be guided at least partially on said wall portions of said cylinder and to radially slide therealong.

2. The device of claim 1, wherein said pistons and slippers form part-ball—formed pivot-beds and portions;

wherein said slippers have seen from bottom or from top the form of an "H", with recesses between the end bars of said "H", and, wherein said pistons have recesses between said extensions of said pistons to receive therein the medial portions of said slippers and to provide space for said medial portions of said slippers to pivot within said recesses between said extensions of slippers shoes.

3. The device of claim 1;

wherein said extensions extend radially beyond the pivot-centre of the slipper in the piston.

4. The device of claim 1;

wherein said extensions extend beyond the pivot-centre of the respective slipper in the respective piston and extend into said slots of said slipper between said guide portions of said slipper of the said "H-form".

5. The device of claim 1;

wherein said extensions of said piston extend beyond the outer face of said slipper and thereby radially outward beyond said slipper and into a groove in the said piston stroke actuator and thereby also beyond the inner slipper-guide face of said piston stroke guide means or piston stroke actuator.

6. The device of claim 1,
wherein retaining means are provided on said extensions for holding said slippers within portions of said pistons.

7. The device of claim 6,
wherein said piston shoes are provided with pairs of outcuts or recesses, located substantially in the radial hight of the pivot-centre of the piston—piston-shoe assembly or slightly radially outward thereof, wherein one recess of a pair of recesses is provided diametrically of the other, and,
wherein a pair of retaining means is provided and each retaining means of said pair of means extends into one of said recesses and into one of said extensions of said piston.

8. The device of claim 6;
wherein said retaining means extend through said piston shoe into recesses of said pistons.

9. The device of claim 8;
wherein said recesses permit a pivoting motion of said retaining means within said recesses.

10. The device of claim 6,
wherein said retaining means are provided radially outwards of said piston shoes, and
wherein said retaining means extend into said radial extensions of said piston shoes.

11. The device of claim 10,
wherein said retaining means is a spring plate, extending into groove portions in said extensions of said pistons.

12. The device of claim 10,
wherein said retaining means are pins, fastened in said extensions of said pistons.

13. The device of claim 1,
wherein said piston shoes contain medial portions and wherein said medial portions are forming part-cylindrical bars, which are meeting the outer faces of said piston shoes, whereby it becomes possible to machine said medial portions between end portions of said piston shoes on round running machines.

14. The device of claim 1,
wherein said slippers form an upper portion and a bottom portion,
wherein undercuts or undersecting recesses extending between the outer dimensions of said portions into said slippers are prevented; and,
whereby said portions are forming configurations, which can be formed from the top and from the bottom without undersecting work into them or between them.

15. The device of claim 1,
wherein lateral or tangential fluid pressure pockets are provided between the respective piston walls and cylinder walls, extending into said pistons or into said walls of said cylinders;
wherein communication passages are provided and control means of said communication passages are provided for the alternating control of flow of fluid under pressure into one or the other recess of pairs of recesses of said fluid pressure pockets,
wherein one of said recesses of a respective pair of recesses is located diametrically of the other recess of said pair relatively to the respective piston, and, wherein said fluid pressure pockets are located substantially in the radial height of the respective pivot-centre of the respective piston and piston-shoe assembly.

16. The device of claim 15,
wherein said fluid pressure pockets are located in the substantially in the middle of the radial length of the respective guide portion of the respective piston.

17. The device of claim 15,
wherein plural pairs of fluid pressure recesses or fluid pressure pockets are provided at different radial hights of the respective piston, and,
wherein temporarily and alternating communication passages are provided in said device, for example in the wall of the respective cylinder to temporarily communicate and discommunicate said pairs of fluid pressure pockets during a radial stroke of the respective piston.

18. In a radial piston device, wherein fluid flows from inlet means through passages into and through substantially radially arranged cylinders of a rotor revolvably mounted in a housing of said device and discharges out from said cylinders through passages and outlet means,
the combination of pistons reciprocating in said cylinders with piston-shoes interposed between a piston stroke guide and actuator means and the pistons, a piston shoe-piston bearing for each individual piston and shoe located parallel to the axis of rotation of said rotor which makes said piston-shoe pivotable on the respective bearing bed in the respective piston;
an "H-form" of each individual shoe when seen from top, having slots between the guide portions which are located laterally of said slots on said shoes;
each individual cylinder of said cylinders provided with wall-portions which extend from portions of the wall of said cylinder in the directions of said respective portions of the wall of said cylinder along respective radial extension segments of said rotor; and an improvement;
wherein said improvement consists in the provision of radial extensions of portions of said pistons in radially outward direction relative to said rotor,
wherein said extensions are located perpendicular to the axis of said piston shoe-piston bearing and at least partially outwardly of said rotor,
wherein retaining means are provided between said extensions and radially outwardly of a portion of said piston-shoe for holding said piston and shoe in a joint and pivotable arrangement of said shoe on said piston, and,
wherein said extensions form face portions extending from the outer face of said piston in the direction of the respective portion of said outer face of said piston to be guided on said wall portions of said cylinder and to radially slide therealong.

19. The device of claim 18,
wherein said extensions extend radially beyond the pivot-centre of the piston shoe in the piston.

20. The device of claim 18,
wherein said extensions extend beyond the pivot-centre of the respective piston shoe in the respective piston and extend into said slots of said piston shoe between said guide portions of said piston shoe of the said "H-form".

21. The device of claim 18,
wherein said extensions of said piston extend beyond the outer face of said piston shoe and thereby radially outward beyond said piston shoe and into a groove in the said piston stroke actuator and thereby also beyond the inner piston shoe-guide face of said piston stroke guide means or piston stroke actuator.

22. The device of claim 18, wherein retaining means are provided on said extensions for holding said piston shoes within said pistons.

23. The device of claim 18, wherein said piston shoes form an upper portion and a bottom portion, wherein undercuts or undersecting recesses extending between the outer dimensions of said portions into said piston shoes are prevented; and, whereby said portions are forming configurations, which can be formed from the top and from the bottom without undersecting work into them or between them.

24. The device of claim 18, wherein said pistons and piston shoes form part-ball formed pivot-beds and portions;

wherein said piston shoes have seen from bottom or from top the form of an "H", with recesses between the end bars of said "H", and, wherein said pistons have recesses between said extensions of said pistons to receive therein the medial portions of said piston shoes and to provide space for said medial portions of said piston shoes to pivot within said recesses between said extensions of said piston shoes.

25. The device of claim 18, wherein lateral or tangential fluid pressure pockets are provided between the respective piston walls and cylinder walls, extending into said pistons or into said walls of said cylinders;

wherein communication passages are provided and control means of said communication passages are provided for the alternating control of flow of fluid under pressure into one or the other recesses of pairs of recesses of said fluid pressure pockets, wherein one of said recesses of a respective pair of recesses is located diametrically of the other recess of said pair relatively to the respective piston, and, wherein said fluid pressure pockets are located substantially in the radial hight of the respective pivot-centre of the respective piston and piston-shoe assembly.

26. The device of claim 25, wherein said fluid pressure pockets are located in the substantially in the middle of the radial length of the respective guide portion of the respective piston.

27. The device of claim 25, wherein plural pairs of fluid pressure recesses or fluid pressure pockets are provided at different radial hights of the respective piston, and, wherein temporarily and alternating communication passages are provided in said device, for example in the wall of the respective cylinder to temporarily communicate and discommunicate said pairs of fluid pressure pockets during a radial stroke of the respective piston.

* * * * *